US010577899B2

(12) United States Patent
Weber et al.

(10) Patent No.: US 10,577,899 B2
(45) Date of Patent: Mar. 3, 2020

(54) COMBINED CASING FILL-UP AND DRILL PIPE FLOWBACK TOOL AND METHOD

(71) Applicant: Frank's International, LLC, Houston, TX (US)

(72) Inventors: Matthew Weber, Duson, LA (US); Keith Lutgring, Lafayette, LA (US); Logan Smith, Lafayette, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 216 days.

(21) Appl. No.: 15/602,237

(22) Filed: May 23, 2017

(65) Prior Publication Data

US 2017/0335666 A1 Nov. 23, 2017

Related U.S. Application Data

(60) Provisional application No. 62/340,481, filed on May 23, 2016.

(51) Int. Cl.

| | |
|---|---|
| ***E21B 19/16*** | (2006.01) |
| ***E21B 43/10*** | (2006.01) |
| *E21B 3/02* | (2006.01) |
| *E21B 17/042* | (2006.01) |

(Continued)

(52) U.S. Cl.
CPC ..... *E21B 43/10* (2013.01); *E21B 19/16* (2013.01); *E21B 3/02* (2013.01); *E21B 17/042* (2013.01); *E21B 17/08* (2013.01); *E21B 19/06* (2013.01)

(58) Field of Classification Search
CPC ..... E21B 19/16; E21B 21/106; E21B 21/10
See application file for complete search history.

(56) References Cited

U.S. PATENT DOCUMENTS 5,148,408 A * 9/1992 Matthews ..... E21B 47/16 367/82
5,735,348 A 4/1998 Hawkins
5,971,079 A 10/1999 Mullins
(Continued)

OTHER PUBLICATIONS

Agnes Wittmann-Regis (Authorized Officer), International Preliminary Report on Patentability dated Dec. 6, 2018, PCT Application No. PCT/US2017/033924, filed May 23, 2017, pp. 1-10.
(Continued)

*Primary Examiner* — William D Hutton, Jr.
*Assistant Examiner* — Steven A Macdonald
(74) *Attorney, Agent, or Firm* — MH2 Technology Law Group LLP

(57) ABSTRACT

A system and method for installing a tubular in a wellbore, of which the method includes coupling a fluid connector tool to a lifting assembly, coupling a casing fill-up and circulation seal assembly to the fluid connector tool, and coupling two segments of casing together to form a casing string. At least one of the segments of casing is fluidically coupled to the casing fill-up and circulation seal assembly. The method also includes running the casing string into a wellbore, pumping a first fluid from the lifting assembly, through the fluid connector tool and the casing fill-up and circulation seal assembly, and into the casing string as the casing string is run into the wellbore, de-coupling the casing fill-up and circulation seal assembly from the fluid connector tool, and coupling a drill-pipe seal assembly to the fluid connector tool.

13 Claims, 12 Drawing Sheets

(51) Int. Cl.
*E21B 17/08* (2006.01)
*E21B 19/06* (2006.01)

(56) References Cited

U.S. PATENT DOCUMENTS

| | | | | |
|---|---|---|---|---|
| 6,364,012 | B1 * | 4/2002 | Adams | E21B 19/002 166/368 |
| 6,390,190 | B2 * | 5/2002 | Mullins | E21B 17/07 166/90.1 |
| 8,006,753 | B2 | 8/2011 | Swietlik et al. | |
| 2006/0151181 | A1 | 7/2006 | Shahin | |
| 2009/0205827 | A1 * | 8/2009 | Swietlik | E21B 19/08 166/285 |
| 2009/0205836 | A1 * | 8/2009 | Swietlik | E21B 19/08 166/377 |
| 2009/0205837 | A1 | 8/2009 | Swietlik et al. | |
| 2012/0048574 | A1 | 1/2012 | Wiens et al. | |
| 2012/0080182 | A1 | 4/2012 | Mullins | |
| 2015/0129198 | A1 | 5/2015 | Kunec | |

OTHER PUBLICATIONS

Jong Kyung Lee (Authorized Officer), International Search Report and Written Opinion dated Aug. 21, 2017, PCT Application No. PCT/US2017/033924, filed May 23, 2017, pp. 1-14.
Extended European Search Report dated Dec. 6, 2019, EP Application No. 17803391.6, pp. 1-7.

* cited by examiner

COMBINED CASING FILL-UP AND DRILL PIPE FLOWBACK TOOL AND METHOD

CROSS-REFERENCE TO RELATED APPLICATIONS

This application claims priority to U.S. Provisional Patent Application having Ser. No. 62/340,481, which was filed on May 23, 2016, and is incorporated herein by reference in its entirety.

BACKGROUND

The process of drilling subterranean wells to recover oil and gas from reservoirs includes boring a hole in the earth down to the petroleum accumulation and installing pipe from the reservoir to the surface. Casing is a protective pipe liner within the wellbore that is cemented in place to ensure a pressure-tight connection to the oil and gas reservoir. The casing is run in continuous strings of joints that are connected together as the string is extended into the wellbore.

On occasion, the casing becomes stuck, preventing it from being lowered further into the wellbore. When this occurs, load or weight is added to the casing string to force the casing into the wellbore, or drilling fluid is circulated down the inside diameter of the casing and out of the casing into the annulus in order to free the casing from the wellbore. To accomplish this, special rigging is typically installed to add axial load to the casing string or to facilitate circulating the drilling fluid.

Further, when running casing, drilling fluid is added into each section of casing as it is run into the well. This fluid prevents the casing from collapsing due to high pressures within the wellbore acting on the outside of the casing. The drilling fluid also acts as a lubricant, facilitating lowering the casing within the wellbore. As each joint of casing is added to the string, drilling fluid is displaced from the wellbore.

The normal sequence for running casing involves suspending the casing from a top drive, or drilling hook on a rotary rig, lowering the casing string into the wellbore, and filling each joint of casing with drilling fluid. The filling of each joint or stand of casing as it is run into the hole is referred to as the fill-up process. Lowering the casing into the wellbore is facilitated by alternately engaging and disengaging elevator slips and spider slips with the casing string in a stepwise fashion, allowing the connection of additional joints or stands of casing to the top of the casing string as it is run into the wellbore.

Circulation of the fluid is sometimes utilized when resistance is encountered as the casing is lowered into the wellbore, preventing the running of the casing string into the hole. This resistance to running the casing into the hole may be due to such factors as drill cuttings or mud cake being trapped within the annulus between the wellbore and the outside diameter of the casing, or caving of the wellbore among other factors. To free the casing, fluid is pumped down through the interior of the casing string and out from the bottom, then through the annulus and up to the surface to free/remove any obstruction. To circulate the drilling fluid, the top of the casing is sealed so that the casing can be pressurized with drilling fluid. Generally, the fluid connection between the rig's mud pumping system and the interior of the casing string includes the rig's top drive and the casing fill-up and circulation tool. The casing fill-up and circulation tool typically includes a mud valve that selectively permits pumping of fluid (drilling mud) from the rig's mud system to the interior of the casing string. The casing fill-up and circulation tool also includes a seal assembly to seal the annular space between the interior of the casing and the outer diameter of the casing fill-up and circulation tool. Since the casing interior is under pressure, the integrity of the seal is critical to safe operation, and to minimize the loss of expensive drilling fluid. Once the obstruction is removed, the casing may be run into the hole as before.

Once the casing string has been assembled to the required length, a crossover connection may then be connected to the top of the last casing joint or string hanger. High strength drill pipe is then connected to this crossover connection. As this high strength drill string, known as a landing string, is assembled, the casing string is then lowered into its desired location within the wellbore.

A drill pipe flowback tool is used when lowering the landing string to allow drilling fluid that is expelled through the ID of the landing string to be contained and directed to a low back pressure port or to the top drive where it is directed back to a reservoir. Generally, the drill pipe flowback tools require the rig down of the casing fill-up and circulation tool in order for the drill pipe flowback tool to be rigged up to the rig's top drive.

SUMMARY

Embodiments of the disclosure may provide a method for installing a tubular in a wellbore. The method includes coupling a fluid connector tool to a lifting assembly, coupling a casing fill-up and circulation seal assembly to the fluid connector tool, and coupling two segments of casing together to form a casing string. At least one of the segments of casing is fluidically coupled to the casing fill-up and circulation seal assembly. The method may also include running the casing string into a wellbore, pumping a first fluid from the lifting assembly, through the fluid connector tool and the casing fill-up and circulation seal assembly, and into the casing string as the casing string is run into the wellbore, de-coupling the casing fill-up and circulation seal assembly from the fluid connector tool after the first fluid is pumped into the casing string, and coupling a drill-pipe seal assembly to the fluid connector tool after the casing fill-up and circulation seal assembly is de-coupled from the fluid connector tool.

Embodiments of the disclosure may also provide a system for installing a tubular in a wellbore. The system includes a fluid connector tool having a first end thereof configured to be coupled to a lifting assembly. The fluid connector tool includes a body having an axial bore extending at least partially therethrough. A port is defined laterally-through the body to provide a path of fluid communication from the axial bore to an exterior of the body. The fluid connector also includes a piston-rod positioned at least partially within the bore, a tube positioned at least partially within the piston-rod, wherein the tube is stationary with respect to the body, and a piston coupled to or integral with the piston-rod and positioned in an annulus formed between the body and the tube. The piston-rod is configured to move axially with respect to the body between a retracted position and an extended position. The system also includes a casing fill-up and circulation seal assembly configured to be coupled to a lower end of the body. The casing fill-up and circulation seal assembly is configured to be inserted at least partially into a casing segment so as to form a fluid flowpath between the bore of the body and an interior of the casing segment.

Embodiments of the disclosure may also provide a fluid connector tool. The fluid connector tool includes a body having an axial bore extending at least partially therethrough. A port is defined laterally-through the body to provide a path of fluid communication from the axial bore to an exterior of the body. The tool also includes a piston-rod positioned at least partially within the bore, a tube positioned at least partially within the piston-rod, wherein the tube is stationary with respect to the body, and a piston coupled to or integral with the piston-rod and positioned in an annulus formed between the body and the tube. The piston-rod is configured to move axially with respect to the body from a retracted position to an extended position when fluid is introduced into a first portion of the annulus to exert a force on the piston.

The foregoing summary is intended merely to introduce a subset of the features more fully described of the following detailed description. Accordingly, this summary should not be considered limiting.

BRIEF DESCRIPTION OF THE DRAWINGS

The accompanying drawings, which are incorporated in and constitute a part of this specification, illustrate an embodiment of the present teachings and together with the description, serve to explain the principles of the present teachings. In the figures.

Figure 1:
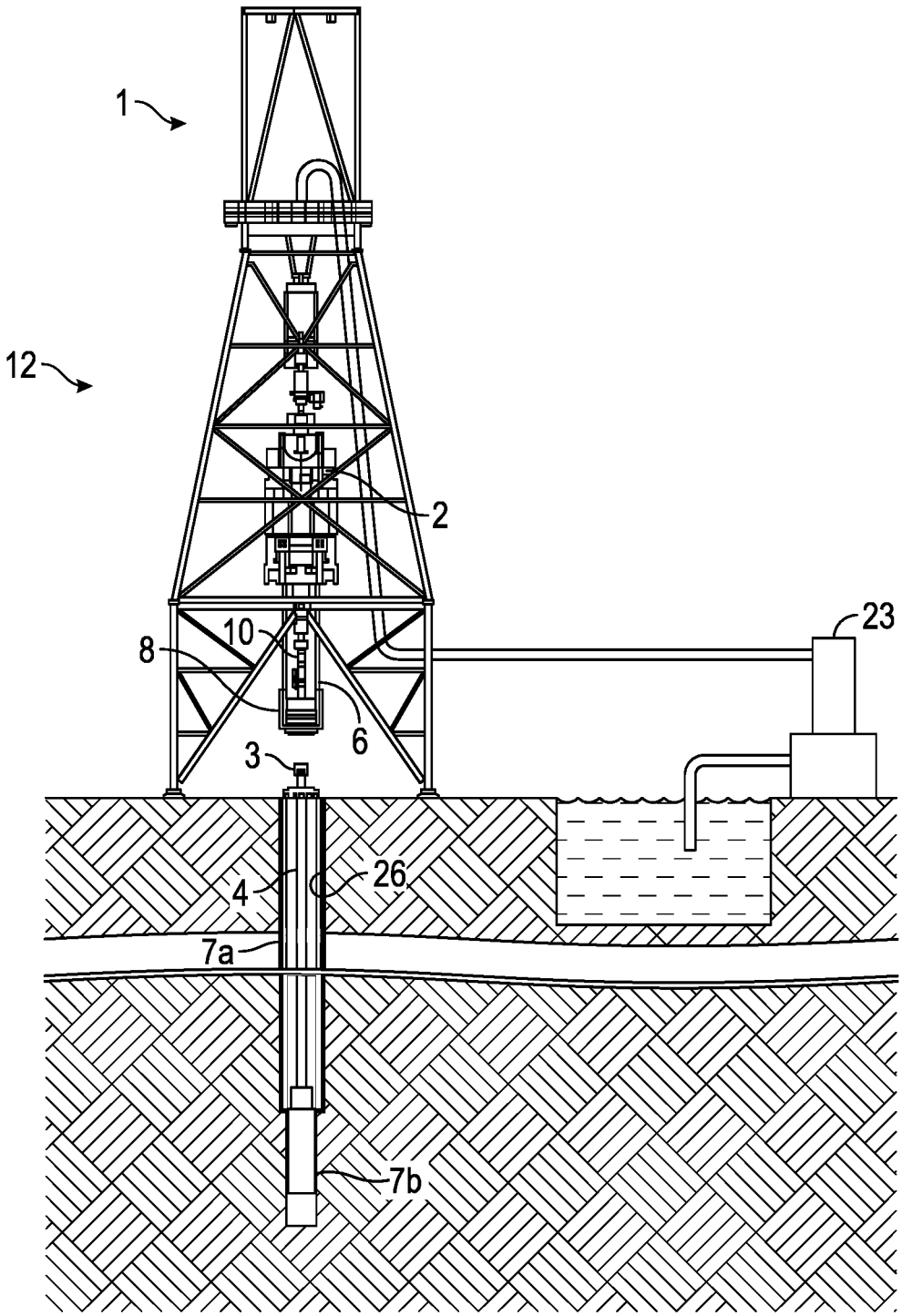
FIG. 1 illustrates a side view of a wellsite system, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms a part thereof, and in which is shown by way of illustration a specific exemplary embodiment in which the present teachings may be practiced. The following description is, therefore, merely exemplary.

In general, embodiments of the present disclosure provide a combination casing fill-up and drill pipe flowback tool, which combines the functions of a casing fill-up tool and a drill pipe flowback tool. Once casing fill-up operations are completed, the casing fill-up and circulation seal assembly is de-coupled from the main portion of the tool. While the casing bails, elevator, and spider are replaced with drill pipe hoisting equipment, a drill pipe seal assembly portion is threaded onto the extendable rod of the main portion of the tool. Change out of the casing seal assembly to the drill pipe landing string seal assembly is accomplished in less time, and with less exposure to safety hazards, than the complete rig down of the casing fill-up and circulation tool and rig up of the drill pipe flow back tool. Lowering of the casing and landing string, which is accompanied by various degrees of flowback, is now ready to commence, and precious time and resources have been saved during this cross-over stage between the casing string running and landing string running.

FIG. 1 illustrates a side view of a wellsite system 1, according to an embodiment. As shown, the system 1 includes, among other things, a top drive 2 and a plurality of downhole tubulars 4 extending through a casing string 7*a*, with a fluid connector tool 10 is coupled to the top drive 2 and positioned between the top drive 2 and the downhole tubulars 4. The top drive 2 may be capable of raising (i.e., "tripping out") or lowering (i.e., "tripping in") the downhole tubulars 4 through a pair of lifting bails 6, each connected between lifting ears of the top drive 2, and lifting ears of a set of elevators 8. When closed, the elevator 8 grips the downhole tubulars 4 and prevents the string of tubulars 4 from sliding further into a wellbore 26 below.

The movement of the string of downhole tubulars 4 relative to the wellbore 26 may be restricted to the upward or downward movement of the top drive 2. While the top drive 2 supplies the upward force to lift the downhole tubulars 4, downward force is supplied by the accumulated weight of the entire free-hanging string of downhole tubulars 4, offset by the accumulated buoyancy forces of the downhole tubulars 4 in the fluids contained within the wellbore 26. Thus, the top drive 2, the lifting bails 6, and the elevators 8 are capable of lifting (and holding) the entire free weight of the string of downhole tubulars 4.

The downhole tubulars 4 may be or include drill pipes (i.e., a drill string 4) connected to casing segments (i.e., a casing string 7*b*), or any other length of generally tubular (or cylindrical) members to be suspended from a rig derrick 12 of the system 1. In a drill string or casing string, the uppermost section (i.e., the "top" joint) of the string of downhole tubulars 4 may include a female-threaded "box" connection 3. In some applications, the uppermost box connection 3 is configured to engage a corresponding male-threaded ("pin") connector at a distal end of the top drive 2 so that drilling-mud or any other fluid (e.g., cement, fracturing fluid, water, etc.) may be pumped through, or flowed back through, the top drive 2 to a bore of the downhole tubulars 4. As the downhole tubular 4 is lowered into the wellbore 26, the uppermost section of downhole tubular 4 is disconnected from top drive 2 before a next joint of the string of downhole tubulars 4 may be added by meshing together threads of the respective connections.

The process by which threaded connections between the top drive 2 and the downhole tubular 4 are broken and/or made-up may be time consuming, especially in the context of lowering an entire string (i.e., several hundred joints) of downhole tubulars 4, segment-by-segment, to a location below the seabed in a deepwater drilling operation. Embodiments of the present disclosure provide improved apparatus and methods to establish the connection between the top drive 2 and the string of downhole tubulars 4 being engaged to or withdrawn and from the wellbore. Embodiments disclosed herein enable the fluid connection between the top drive 2 and the string of downhole tubulars 4 to be made using the fluid connector tool 10 located between top drive 2 and the top joint of string of downhole tubulars 4. In at least one embodiment, the fluid connector tool 10 may be hydraulic. Additional details about the fluid connector tool 10 may be found in U.S. Pat. No. 8,006,753, which is incorporated by reference herein in its entirety to the extent that it is not inconsistent with the present disclosure.

While the top drive 2 is shown in conjunction with the fluid connector tool 10, in certain embodiments, other types of "lifting assemblies" may be used with the fluid connector tool 10 instead. For example, when "running" the downhole tubulars 4 in drilling systems 1 not equipped with a top drive 2, the fluid connector tool 10, the elevator 8, and the lifting bails 6 may be connected directly to a hook or other lifting mechanism to raise and/or lower the string of downhole tubulars 4 while hydraulically connected to a pressurized fluid source (e.g., a mud pump, a rotating swivel, an IBOP, a TIW valve, an upper length of tubular, etc.). Further, while some drilling rigs 12 may be equipped with a top drive 2, the lifting capacity of the lifting ears (or other components) of the top drive 2 may be insufficient to lift the entire length of string of downhole tubulars 4. In particular, for extremely long or heavy-walled tubulars 4, the hook and lifting block of the drilling rig 12 may offer significantly more lifting capacity than the top drive 2.

Accordingly, in the present disclosure, where connections between the fluid connector tool 10 and the top drive 2 are described, various alternative connections between the fluid connector tool 10 and other, non-top drive lifting (and fluid communication) components are contemplated as well. Similarly, in the present disclosure, where fluid connections between the fluid connector tool 10 and the top drive 2 are described, various fluid and/or lifting arrangements are contemplated as well. In particular, while fluids may not physically flow through a particular lifting assembly lifting fluid connector tool 10 and into the downhole tubulars 4, fluids may flow through a conduit (e.g., hose, flex-line, pipe, etc.) used alongside and in conjunction with the lifting assembly and into the fluid connector tool 10.

Figure 2A:
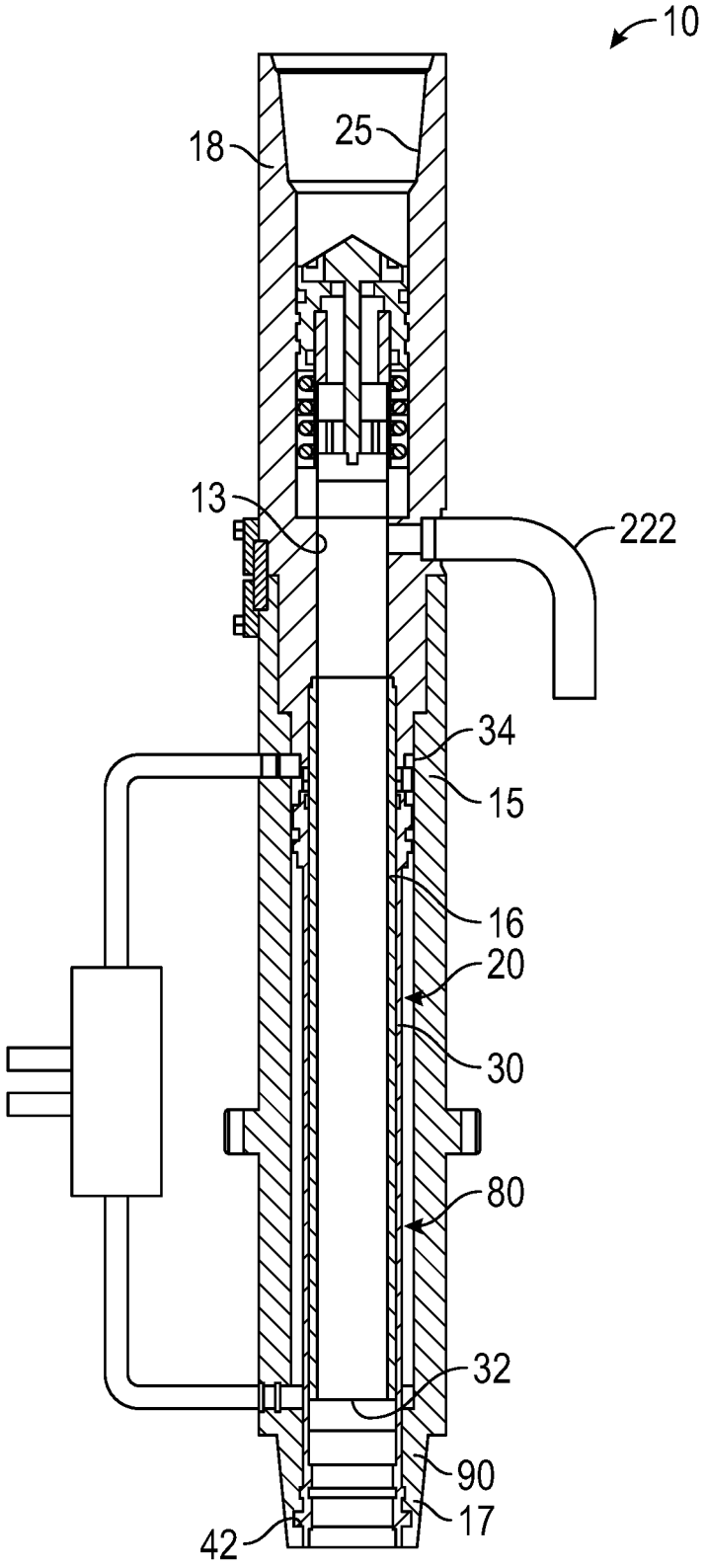
FIG. 2A illustrates a cross-sectional side view of a fluid connector tool that may connect to a top drive and one or more seal assemblies, according to an embodiment.

FIG. 2A illustrates a side, cross-sectional side view of the fluid connector tool 10, according to an embodiment. In particular, the fluid connector tool 10 is shown in a retracted position, as will be described in greater detail below. The fluid connector tool 10 includes a body 15, which may be cylindrical and therefore referred to, in some cases, as a cylinder 15; however, non-cylindrical embodiments are contemplated. The cylinder 15 may have an upper end 18 and a lower end 17. An axial bore 13 may extend at least partially between the upper and lower ends 18, 17.

The fluid connector tool 10 may also include a piston-rod assembly 20. The piston-rod assembly 20 may include a hollow, tubular piston-rod 30 configured to slide within the bore 13 of the cylinder 15. For example, a first (e.g., lower) end 32 of the tubular piston-rod 30 may be configured to slide downward with respect to the cylinder 15, so as to protrude downward from the lower end 17 of the cylinder 15. A second (e.g., upper) end 34 of the piston-rod 30 may be contained within the bore 13 of the cylinder 15. Additional details regarding the movement of the piston-rod 30 are discussed below, in accordance with an example embodiment.

The piston-rod 30 may be disposed about a tube 16 positioned within the bore 13. The tube 16 may be stationary with respect to the cylinder 15. The piston-rod 30, the cylinder 15, and the tube 16 may be arranged such that their longitudinal axes are coincident. The piston-rod 30 may be slidably disposed about the tube 16 such that the piston-rod assembly 20 telescopically extends through the cylinder 15 from the retracted position to the extended position. Further, the lower end 17 of the cylinder 15 may include an end plug 42, through which the tubular piston-rod 30 is able to reciprocate. In some embodiments, the end plug 42 may be integral with the cylinder 15.

A connection (e.g., threaded connection) 90 may be provided on the lower end 17 of the cylinder 15. The threaded connection 90 may be connected to the lower end 17 of cylinder 15 by another threaded connection or may be integral to the cylinder 15. The threaded connection 90 includes a passage and/or a bore to allow the piston-rod 30 to pass therethrough as the piston-rod 30 reciprocates between the retracted and extended positions. In some embodiments, the threaded connection 90 may be a pin-end connection and may be received into and connected to (e.g., by meshing threads) the box connection 3 at the top end of the downhole tubulars 4 (see, e.g., FIG. 6A). In some embodiments, a fluid-tight connection between the connection 90 and the downhole tubulars 4 may be formed by such engagement.

The opposite (or upper) end 18 of the cylinder 15 may include a threaded connection 25 for engagement with the top drive 2. The threaded connection 25 may be a female box connection that may be configured to engage a corresponding pin thread of the top drive 2 (FIG. 1). Therefore, the top drive 2 may provide drilling fluid to the cylinder 15 through the threaded connection 25.

Figure 2B:
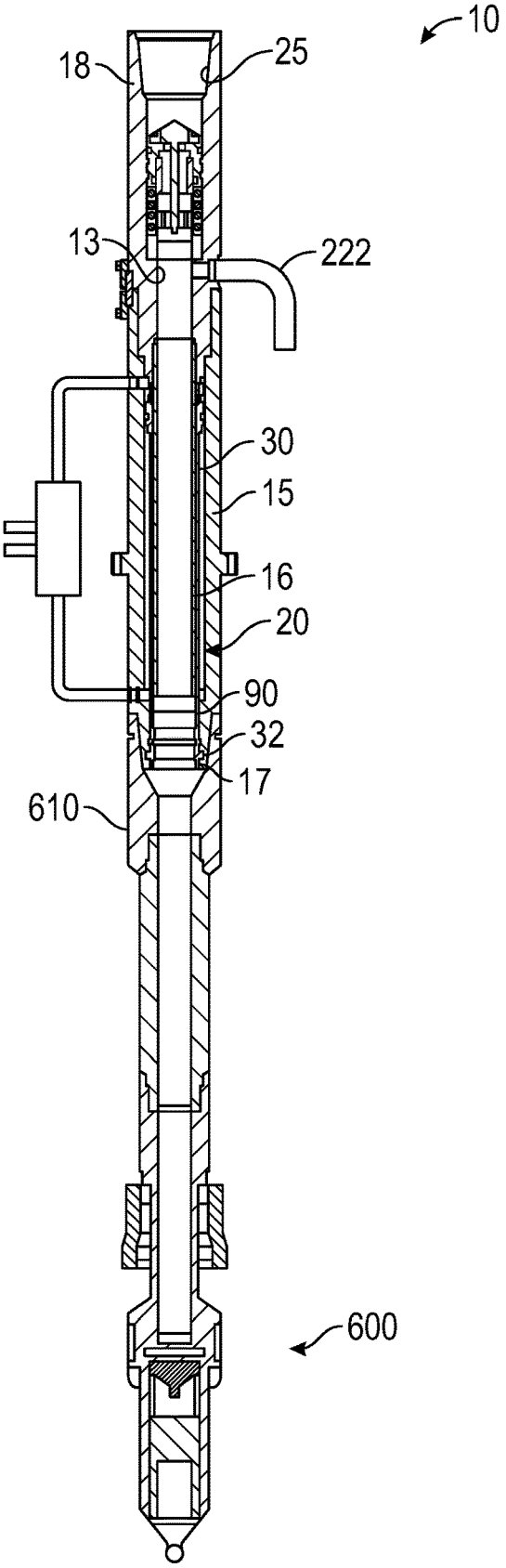
FIG. 2B illustrates a cross-sectional side view of the fluid connector tool connected to a casing fill-up and circulation seal assembly and thus configured for casing fill-up and circulation, according to an embodiment.

The lower end 32 of the piston-rod 30 may be configured to connect to one of two or more sealing assemblies. FIG. 2B illustrates a side, cross-sectional view of the fluid connector tool 10 coupled to an example of one such assembly, in this case, a casing fill-up and circulation seal assembly 600, according to an embodiment. The casing fill-up and circulation seal assembly 600 may be configured to be received at least partially into and form a seal with a casing string, as will be described in greater detail below. One illustrative casing fill-up and circulation seal assembly 600 is described in U.S. Pat. No. 5,735,348, which is incorporated by reference herein in its entirety to the extent that it is not inconsistent with the present disclosure. However, as will be appreciated, other casing fill-up and circulation seal assemblies may also be used.

To connect to the casing fill-up and circulation seal assembly 600, the fluid connector tool 10 may be provided with an adapter 610. The adapter 610 may, for example, include two female, threaded connections and may be connected, e.g., via the threaded connection 90, to the cylinder 15. The casing fill-up and circulation seal assembly 600 may include one or more connections 615 that connect to the adapter 610. The adapter 610, connection 615, and the remainder of the casing fill-up and circulation seal assembly 600 may be hollow, such that fluid communication is provided from the bore 13 through the adapter 610 and through the casing fill-up and circulation seal assembly 600 and, e.g., to a casing in which the casing fill-up and circulation seal assembly 600 is sealed.

Figure 3:
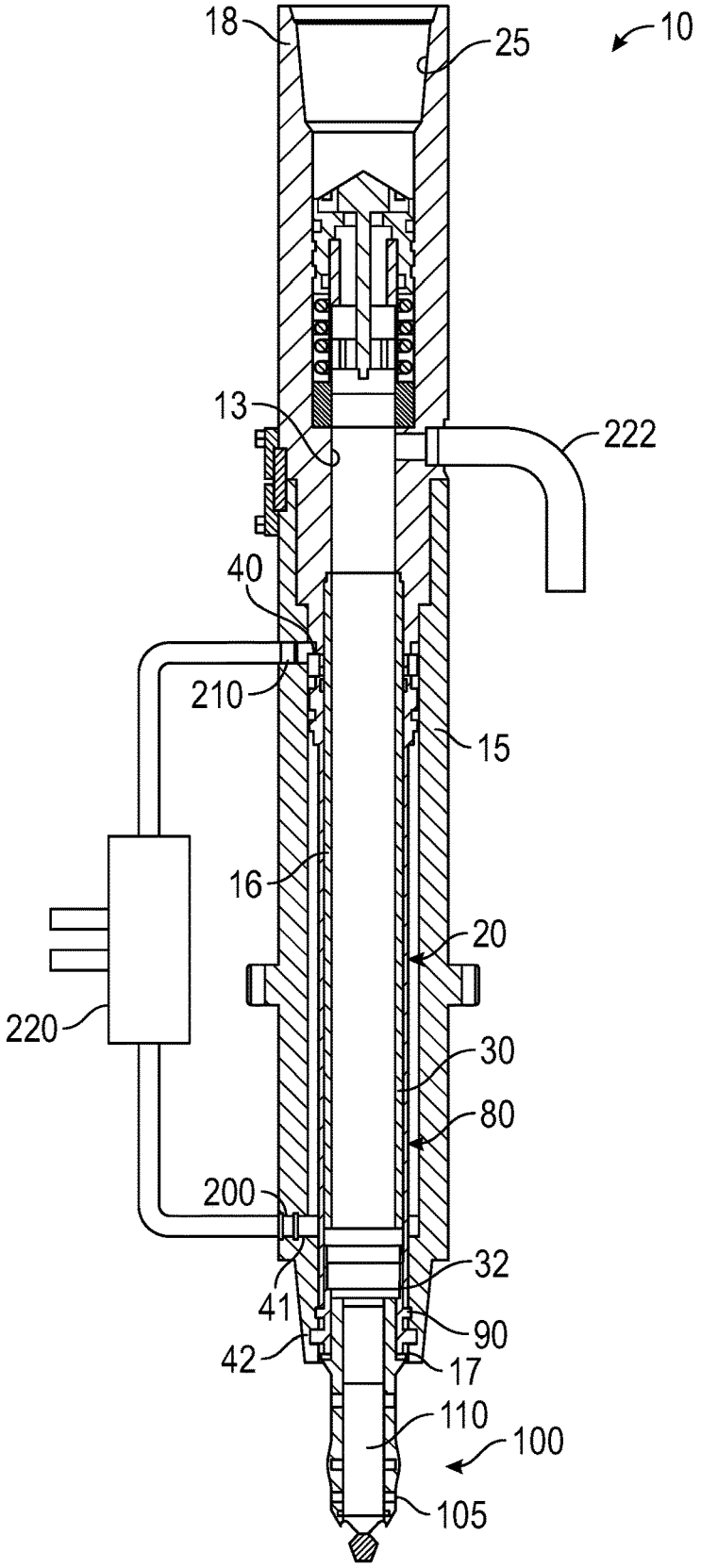
FIG. 3 illustrates a cross-sectional side view of the fluid connector tool in a retracted position and coupled to a drill pipe seal assembly and thus configured for drill-pipe flow back, according to an embodiment.
Figure 4:
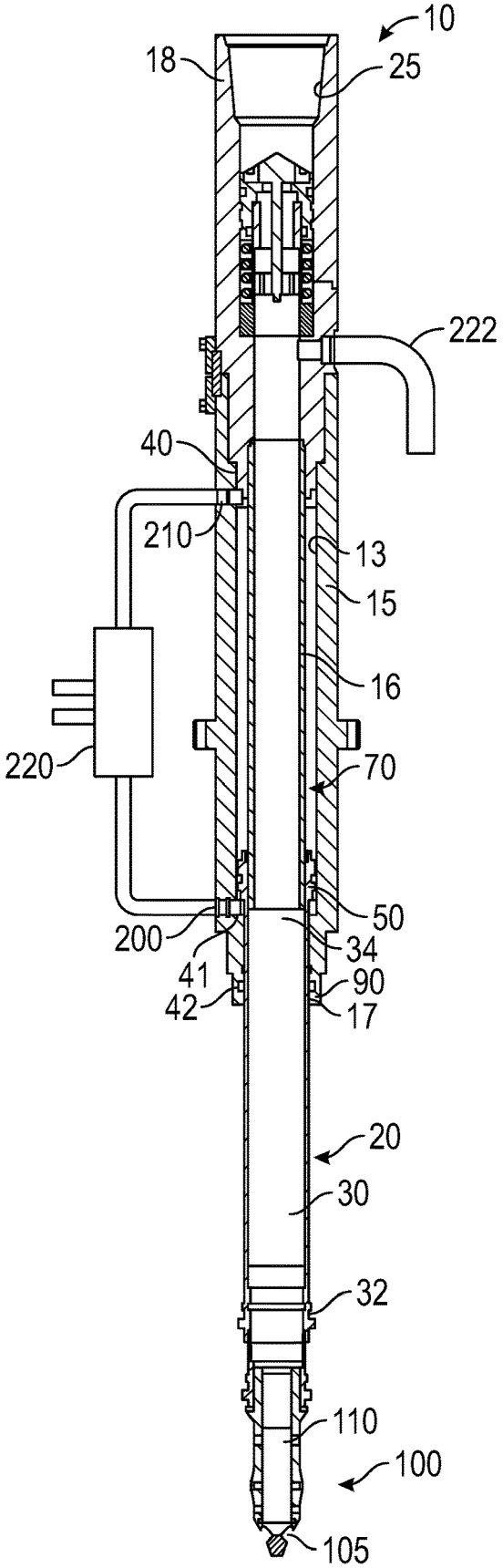
FIG. 4 illustrates a cross-sectional side view of the fluid connector tool coupled to the drill pipe seal assembly, as in FIG. 3, but in an extended position, according to an embodiment.

Another such assembly may be a drill-pipe seal assembly 100, as shown in FIGS. 3 and 4, which may be configured to seal with a drill pipe and form a fluid flowpath from the interior of the drill pipe to the bore 13 of the cylinder 15, e.g., the interior of the tube 16. The drill-pipe seal assembly 100 may be configured to be connected to the end 32 of the piston-rod 30 when the casing fill-up and circulation seal assembly is removed therefrom, and vice versa.

The drill-pipe seal assembly 100 may include, for example, a nose guide 105 and one or more seals (e.g., cup seals) 110. In some embodiments, the nose guide 105 may be made from a resilient and/or elastomeric material (e.g., rubber, nylon, polyethylene, silicone, etc.) and may be shaped to fit into a top end (e.g., box 3) of the string of downhole tubulars 4. The nose guide 105 and the seals 110 may be configured to be received at least partially through a top end of a string of downhole tubulars 4 and seal therewith by extending the piston-rod assembly 20 into an extended position (FIG. 4). The drill-pipe seal assembly 100 may thereby provide a fluid tight seal between the fluid connector tool 10 and the string of downhole tubulars 4. In various embodiments, however, the drill-pipe seal assembly 100 may seal on, in, or around the upper end (e.g. box 3) of the top joint of string of downhole tubulars 4.

The piston-rod assembly 20 further includes a piston 50 disposed at the upper end 34 of the piston-rod 30. The piston 50 is coupled to, e.g., fixed or otherwise rigidly mounted to, the piston-rod 30 and is configured to reciprocate inside the cylinder 15 between an extended position and a retracted position. As shown, the interior of the cylinder 15 may define two shoulders or stops, e.g., an upper shoulder 40 and a lower shoulder 41. The piston 50 may abut the upper shoulder 40 when the piston 50 is in the retracted position and may abut the lower shoulder 41 when the piston 50 is in the extended position.

The piston-rod 30 may be configured to reciprocate via axial movement between a retracted position and an extended position. In the retracted position (FIG. 3), the lower end 32 of the piston-rod 30 is proximal to or received in the lower end 17 of the cylinder 15. In the extended position (FIG. 4), the lower end 32 is spaced axially apart and downward from the lower end 17, as will be described in greater detail below.

In an embodiment, the piston 50 divides an annulus between the tube 16 and the bore 13 of the cylinder 15 into two chambers: a first (e.g., lower) chamber 80 and a second (e.g., upper) chamber 70. In particular, the first chamber 80 is defined by the lower shoulder 41, an inner diameter of the cylinder 15, an outer diameter of the piston-rod 30, and a lower face of the piston 50. Similarly, the second chamber 70 is defined by a upper shoulder 40, the inner diameter of the cylinder 15, an outer diameter of the tube 16, and an upper face of the piston 50. The piston 50, which is coupled to the tubular piston-rod 30, may be sealed against the inner diameter of the cylinder 15 and the outer diameter of the tube 16 by sealing mechanisms, such as O-ring seals, to prevent fluids from communicating between the first and second chambers 80, 70 around the piston 50. While the cylinder 15, the tube 16, the piston-rod 30, and the piston 50 are all shown and described as cylindrical (and therefore having diameters), one of ordinary skill in the art will appreciate that other, non-circular geometries may also be used without departing from the scope of the present disclosure.

The range of motion for retracting the piston-rod assembly 20 may be limited by the drill-pipe seal assembly 100 abutting against the threaded connection 90 in the fully retracted position (FIG. 3) and/or the piston 50 abutting the upper shoulder 40. The range of motion for extending the piston-rod assembly 20 may be limited by abutment of the lower face of the piston 50 with the lower shoulder 41 of the cylinder 15.

In an example embodiment, the first and second chambers 80, 70 may be supplied with pressurized fluid (hydraulic or pneumatic) from a pressurized fluid supply (e.g., a compressor, pump, or a pressure vessel). The first chamber 80 may be in fluid communication with the fluid supply via a first supply port 200, and the second chamber 70 may be in fluid communication with the fluid supply via a second supply port 210. A control valve assembly 220 may be provided between the first and second supply ports 200, 210. The control valve assembly 220 may be selectively connected to the fluid supply and the atmosphere (or a relatively low-pressure vessel). The control valve assembly 220 may be or include, for example, a four-way cross port valve to selectively connect the first and second supply ports 200, 210 to the fluid supply, and the first and second supply ports 200, 210, respectively, to low pressure. The control valve assembly 220 may include shear or solenoid valves configured to alternately supply high and low-pressure hydraulic fluids to the first and second chambers 80, 70, e.g., in embodiments employing hydraulic fluid rather than pressurized air.

In some embodiments, the pressurized fluid supply may selectively provide pressurized fluid to one of the first chamber 80 and the second chamber 70 via the control valve assembly 220, while the other of the first chamber 80 and second chamber 70 is vented to the atmosphere or any other lower pressure. Thus, a pressure differential may be created across the piston 50, from the higher-pressure first chamber 80 to the lower-pressure second chamber 70. As such, a force may be generated on the piston-rod assembly 20, causing the piston-rod assembly 20 to travel upwards to its retracted position. Conversely, the piston-rod assembly 20 may extend when the force acting on the piston 50 due to pressure in the second chamber 70 is higher than the force acting on the piston 50 due to the pressure in the first chamber 80 (FIG. 4).

Figure 5A:
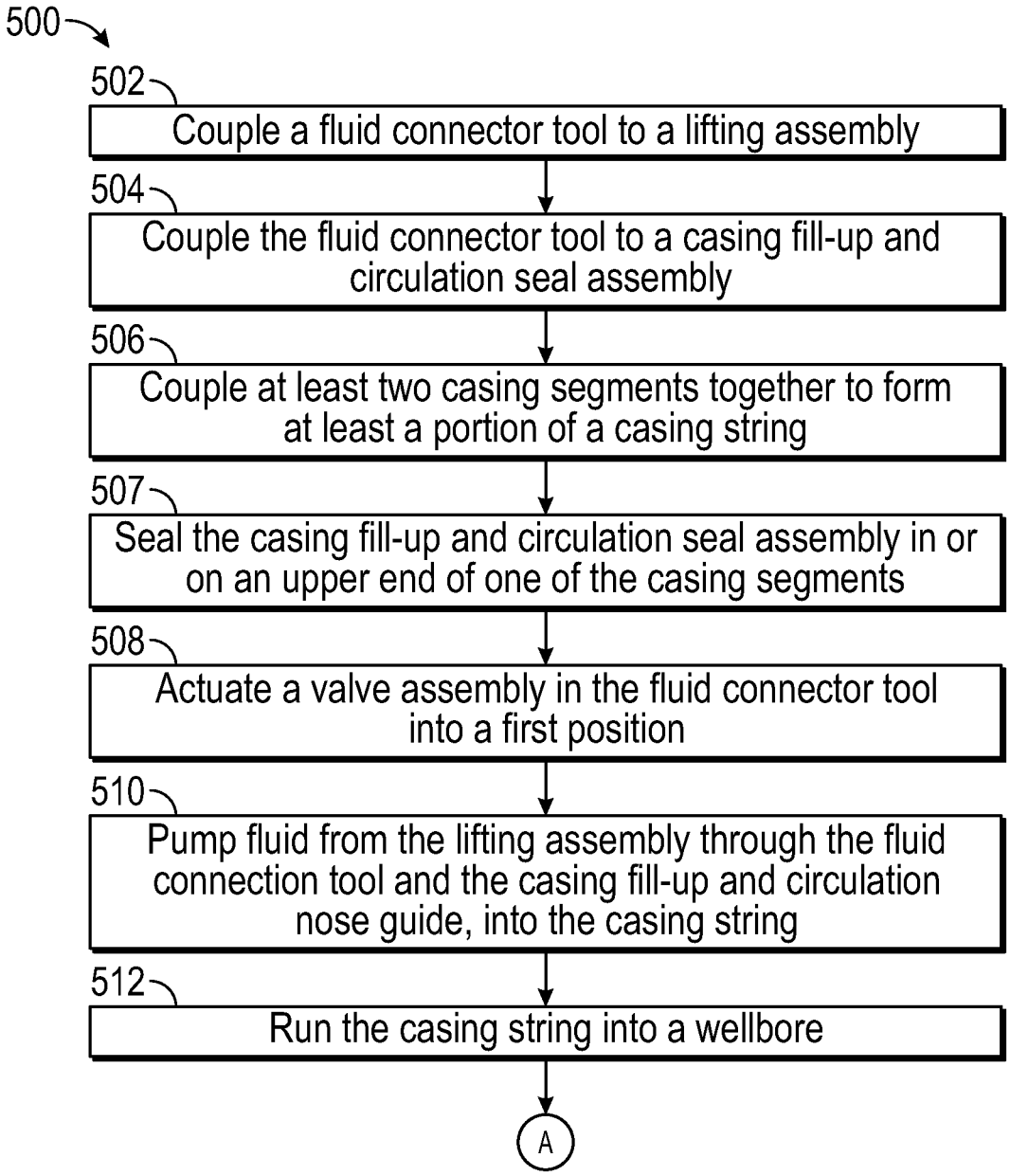
FIGS. 5A, 5B, and 5C illustrate a flowchart of a method for installing a combination casing and landing string in a wellbore, according to an embodiment.
Figure 5B:
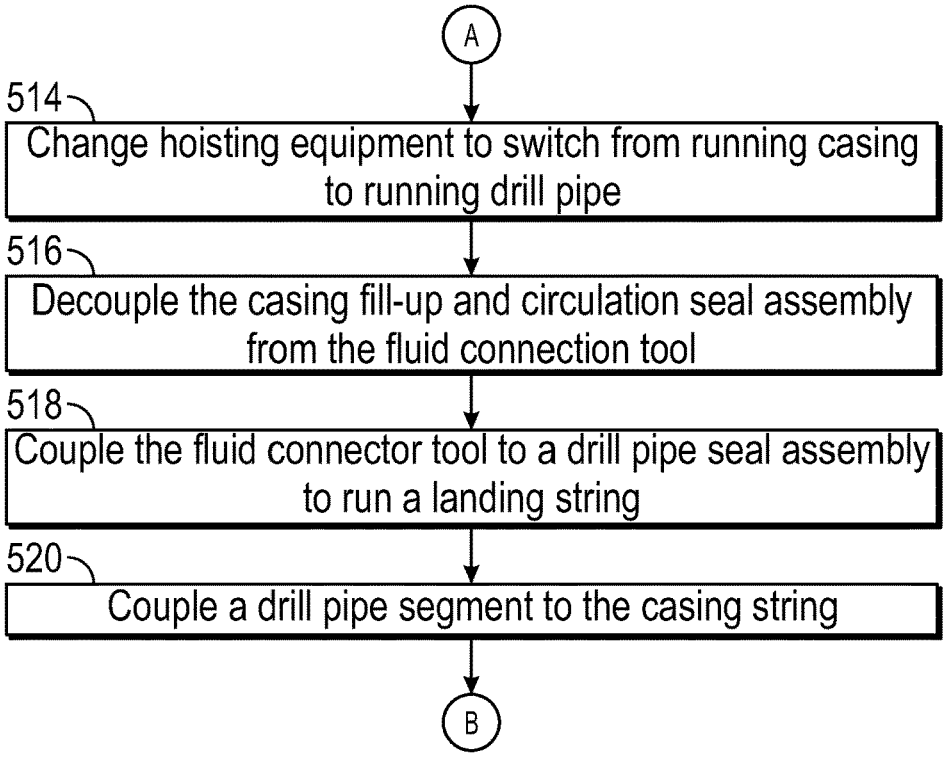
Figure 5C:
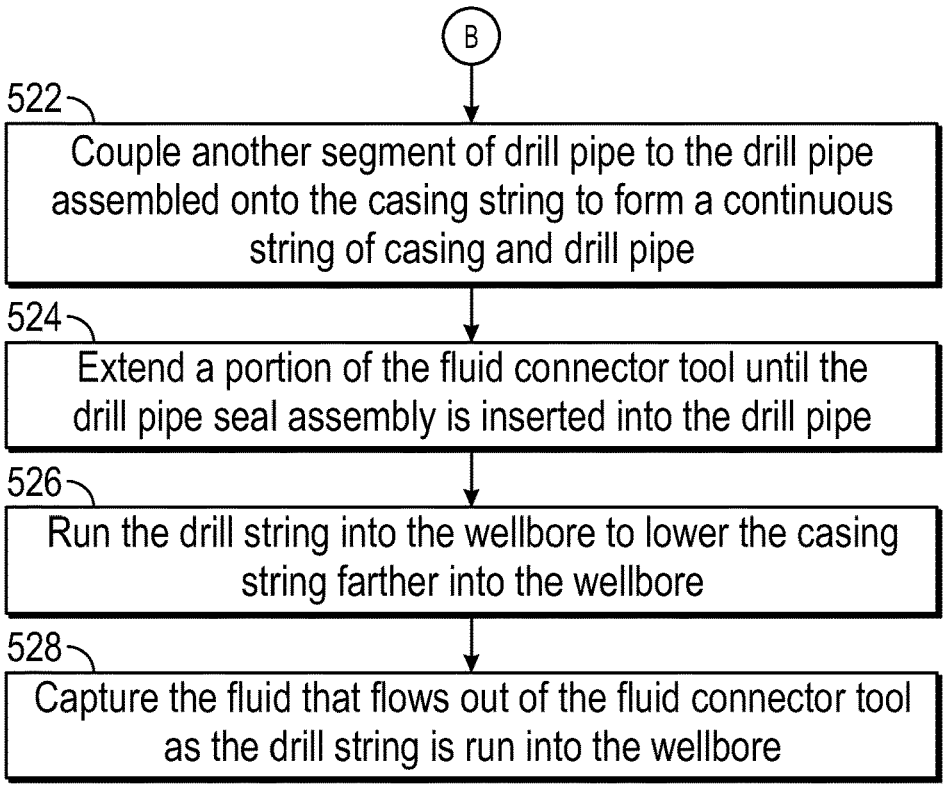

FIGS. 5A, 5B, and 5C illustrate a flowchart of a method 500 for installing a combination casing and landing string in a wellbore 26, according to an embodiment. The method 500 may be viewed together with FIGS. 1-4 and 6A-10B, as referenced below. In particular, FIG. 5A illustrates a casing running sequence of the method 500. The method 500 may include coupling the fluid connector tool 10 to the lifting assembly (e.g., the top drive) 2, as at 502. More particularly, the female box connection 25 at the first (e.g., upper) end of the fluid connector tool 10 may be coupled to the male pin connection of the top drive 2 (or another type of lifting assembly or hoisting device).

Figure 6A:
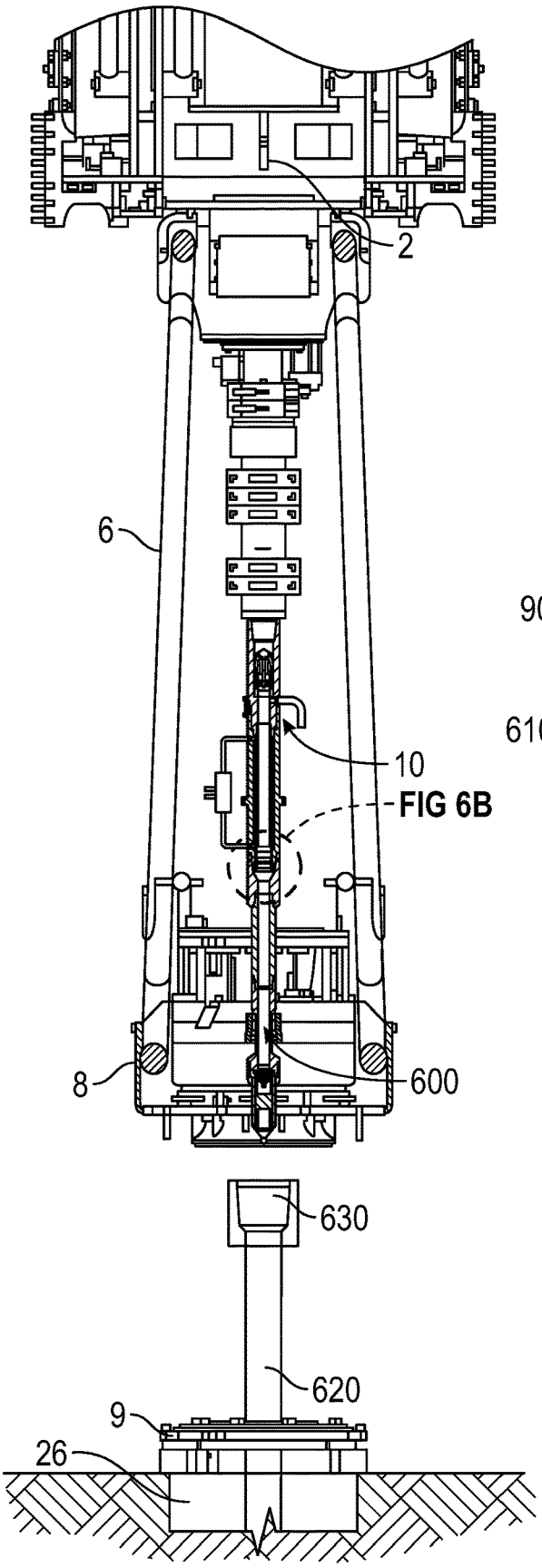
FIG. 6A illustrates a cross-sectional side view of the fluid connector tool coupled to and positioned between the top drive and a casing fill-up and circulation seal assembly, with a piston-rod assembly of the fluid connector tool in a retracted position, according to an embodiment.
Figure 6B:
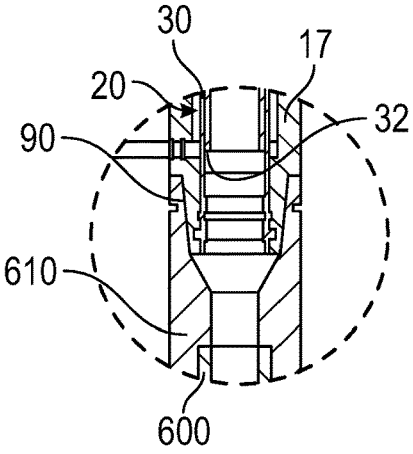
FIG. 6B illustrates an enlarged view of a portion of FIG. 6A, showing the connection between the fluid connector tool and the casing fill-up and circulation seal assembly in greater detail, according to an embodiment.

The method 500 may also include coupling the fluid connector tool 10 to a casing fill-up and circulation seal assembly 600, as at 504. FIG. 6A illustrates a cross-sectional side view of the fluid connector tool 10 coupled to and positioned between the lifting assembly (e.g., the top drive) 2 and the casing fill-up and circulation seal assembly 600, according to an embodiment. FIG. 6B illustrates an enlarged view of the connection of the circulation seal assembly 600 with the fluid connector tool 10, e.g., at the connection 90. As described in greater detail below, the casing fill-up and circulation seal assembly 600 may be configured to seal with and thereby provide a fluid path for introducing drilling fluid into a casing string as the casing string 620 is lowered into the wellbore 26.

As shown, in at least one embodiment, the adapter 610 (FIG. 6B) may be coupled to and positioned between the lower end 17 of the fluid connector tool 10 and the casing fill-up and circulation seal assembly 600. More particularly, the nose guide 105 and the cup seal 110 (shown in FIGS. 3 and 4) may be omitted/removed from the fluid connector tool 10, and the lower end 32 of the piston-rod assembly 20 of the fluid connector tool 10 may be retracted at least partially into the cylinder 15. With the piston-rod assembly 20 in the retracted position, the fluid connector tool 10, e.g., the threaded connection 90 thereof, is coupled to the casing fill-up and circulation seal assembly 600, e.g., via the adapter 610.

Figure 7:
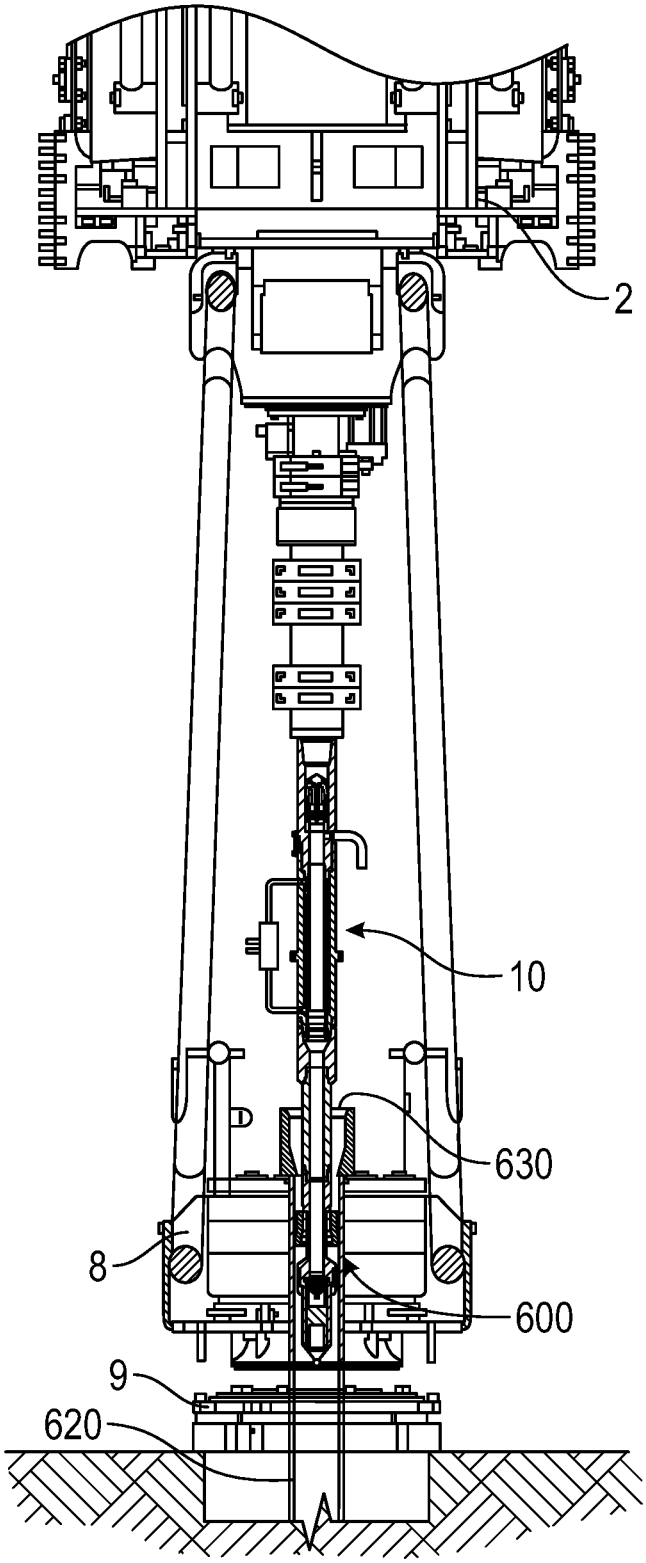
FIG. 7 illustrates a cross-sectional side view of the fluid connector tool coupled to and positioned between the top drive and the casing fill-up and circulation seal assembly, such that the casing fill-up and circulation assembly is received into a tubular, according to an embodiment.

The method 500 may also include coupling at least two casing segments together to form a first tubular (e.g., casing) string 620, as at 506. The casing fill-up and circulation seal assembly 600 may be connected to the casing string 620, as at 507. For example, at 507, the casing fill-up and circulation seal assembly 600 may be lowered by lowering the top drive 2 and elevator 8, such that the casing fill-up and circulation seal assembly 600 stabs into an upper end 630 of an uppermost casing segment of the casing string 620 and/or by otherwise sealing the casing fill-up and circulation seal assembly 600 with the uppermost segment of the casing string 620. The casing fill-up and circulation seal assembly 600 may thus provide a sealed fluid flowpath between the bore 13 of the cylinder 15 of the fluid connector tool 10 and the casing string 620. FIG. 7 illustrates an example of the casing fill-up and circulation seal assembly 600 received into the uppermost end 630 of the casing string 620, so as to provide the fluid flowpath between the fluid connector tool 10 and the interior of the casing string 620.

The method 500 may also include actuating a valve assembly 1000 in the fluid connector tool 10 into a first position, as at 508. The valve assembly 1000 may be actuated into the first position before the casing string 620 is run into the wellbore 26 or as the casing string 620 is run into the wellbore 26. The valve assembly 1000 is shown in the first position in FIG. 10A, and additional aspects of an example of such a valve assembly 1000 are discussed below with reference to FIGS. 10A-10C.

The method 500 may also include pumping fluid from the lifting assembly (e.g., the top drive) 2, through the fluid connector tool 10 and the casing fill-up and circulation seal assembly 600, and into the casing string 620, as at 510. The fluid may also flow through the valve assembly 1000 in the fluid connector tool 10 when the valve assembly 1000 is in the first position. The fluid may be or include drilling mud. The fluid may fill-up and/or circulate within the casing string 620 and, subsequently, the wellbore 26. The casing string 620 may then be run into the wellbore 26, as at 512.

Referring now to FIG. 5B, in at least one embodiment, the casing string 620 may not be lowered below a predetermined depth in the wellbore 26 when the casing fill-up and circulation seal assembly 600 is coupled to the fluid connector tool 10. To lower the casing string 620 below the predetermined depth in the wellbore 26, the casing string 620 may be crossed over to a second tubular (e.g., drill-pipe) string 640 (shown in FIG. 8) and then lowered further in the wellbore 26, as described in greater detail below. FIG. 5B illustrates an example crossover process of the method 500.

To cross the casing string 620 over to the drill-pipe string 640, the method 500 may include changing hoisting equipment to switch from running casing to running drill pipe, as at 514. For example, the hoisting equipment may initially be configured (e.g., sized) to engage the outer surface of the casing string 620, and the hoisting equipment may be changed to be configured (e.g., sized) to engage to engage the outer surface of the drill-pipe string 640. The hoisting equipment may be or include elevators 8, spiders 9 (e.g., FIGS. 6A and 7), and/or the like.

Figure 8A:
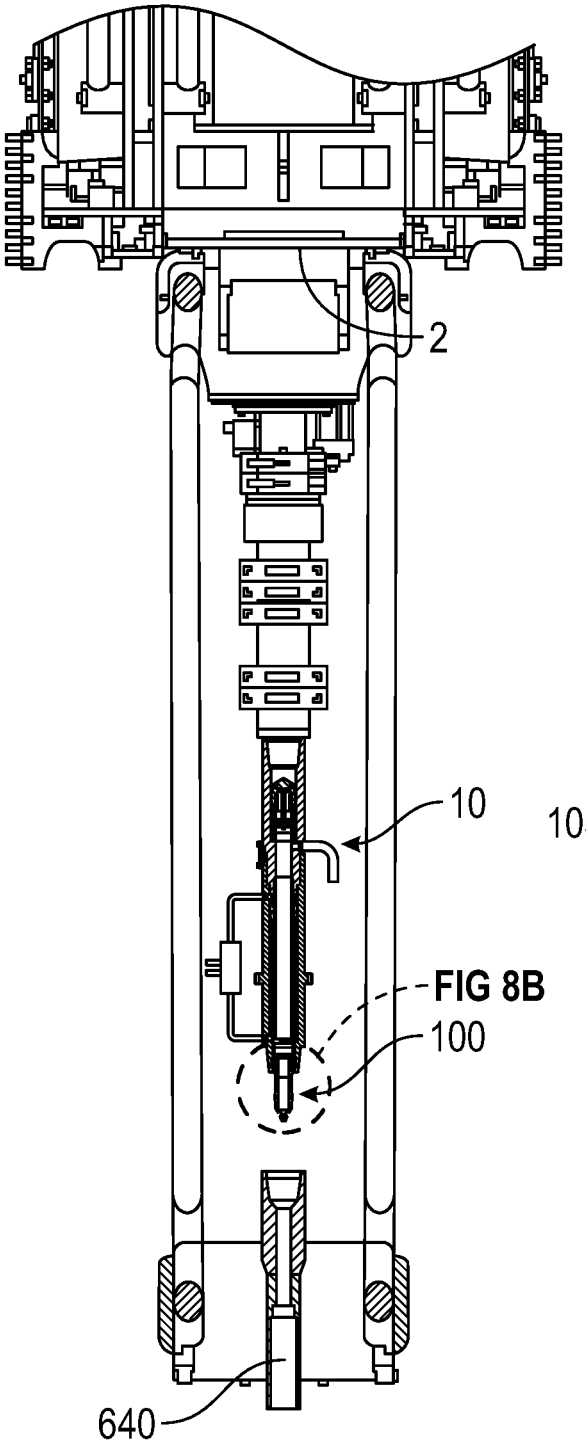
FIG. 8A illustrates a cross-sectional side view of the fluid connector tool with the drill string sealing assembly coupled to the piston-rod assembly, and the piston-rod assembly in the retracted position, according to an embodiment.
Figure 8B:
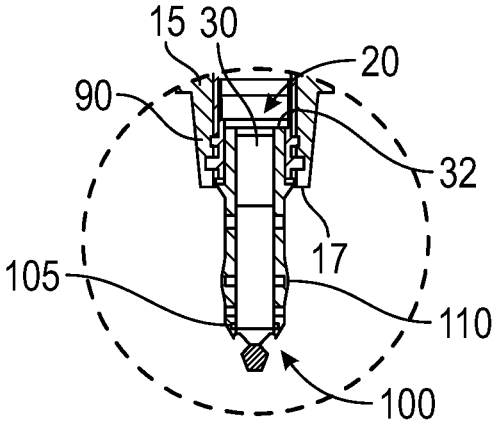
FIG. 8B illustrates an enlarged view of a portion of FIG. 8A, showing the connection between the drill string sealing assembly and the piston-rod assembly in greater detail, according to an embodiment.

The method 500 may also include de-coupling and removing the casing fill-up and circulation seal assembly 600 from the connection 90 at the lower end 17 of the fluid connector tool 10, as at 516. If present, the adapter 610 may also be de-coupled and removed from the fluid connector tool 10 as well. The fluid connector tool 10 may then be coupled to a drill-pipe seal assembly 100, e.g., to run a landing string, as at 518. More particularly, the drill-pipe seal assembly 100 may be coupled to the lower end 32 of the piston-rod assembly 20. FIG. 8A shows the drill-pipe seal assembly 100 coupled to the fluid connector tool 10, and FIG. 8B illustrates an enlarged view of the connection between the lower end 32 of the piston-rod 30 and the nose guide 105, according to an embodiment. The drill-pipe seal assembly 100 may also include the cup seal 110, as described above with reference to FIGS. 3 and 4. The method 500 may also include coupling (i.e., crossing-over) the casing string 620 to the drill-pipe string 640, as at 520.

FIG. 5C illustrates a drill-pipe landing string running sequence of the method 500, according to an embodiment. In this sequence, the method 500 may include coupling another (now uppermost) segment of drill pipe to a drill-pipe string 640 assembled on the casing string 620, to form a continuous, combined string of casing and drill pipe, as at 522. The drill pipe of the drill-pipe string 640 may have a smaller diameter than the casing of the casing string 620. The uppermost drill pipe segment of the drill-pipe string 640 may provide an open end 650.

Figure 9:
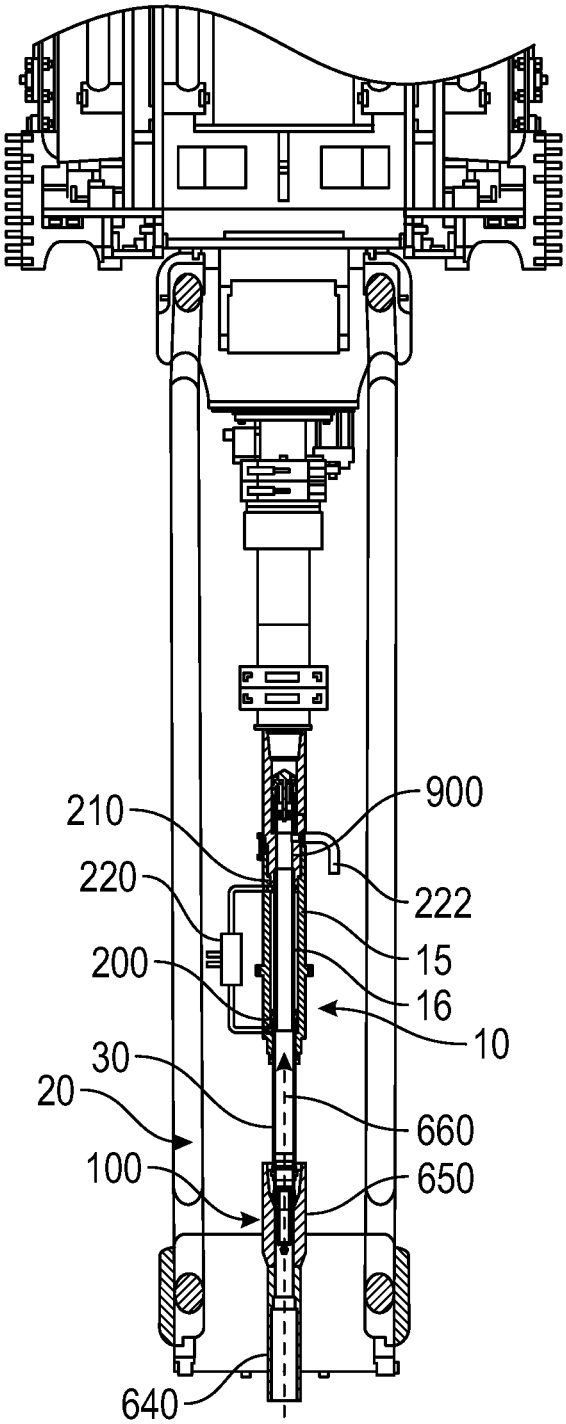
FIG. 9 illustrates a cross-sectional side view of the fluid connector tool with the piston-rod assembly in the extended position, such that the drill string sealing assembly is received into a drill string, according to an embodiment.

The method 500 may also include introducing pressurized fluid (e.g., air or hydraulic fluid) into the fluid connector tool 10 to cause at least a portion of the fluid connector tool 10 (e.g., the piston-rod assembly 20) to extend axially with respect to the cylinder 15 of the fluid connector tool 10 until the drill-pipe seal assembly 100 is inserted at least partially into the drill-pipe string 640, as at 524. FIG. 9 illustrates a cross-sectional side view of the fluid connector tool 10 with the piston-rod assembly 20 in an extended position such that the drill-pipe seal assembly 100 is inserted into the open end 650 of the drill-pipe string 640. As discussed above with reference to FIGS. 3 and 4, to extend the piston-rod assembly 20, fluid (e.g., air or hydraulic fluid) may be introduced into the second chamber 70 of the fluid connector tool 10 through the second supply port 210. The introduction of fluid into the upper chamber 70 causes the piston 50 to move axially-away from the second supply port 210, and away from the upper shoulder 40. The piston-rod assembly 20, particularly the piston-rod 30, moves together with the piston 50. As the piston 50 moves axially-away from the second supply port 210 (e.g., downward as shown in FIG. 9), the fluid (e.g., hydraulic fluid or air) in the chamber 80 may flow out of the first supply port 200 and back into the control valve assembly 220.

In at least one embodiment, the stationary tube 16 is positioned within the piston-rod assembly 20, as mentioned above. One or more seals may be coupled to the piston-rod assembly 20, the stationary tube 16, or both to isolate hydraulic fluid located in the annulus between the piston-rod assembly 20 and the outer body (i.e., cylinder) 15 of the fluid connector tool 10 from the drilling fluid located within the piston-rod assembly 20. The stationary tube 16 and/or the seals allow for control of the hydraulic fluid that is used to extend and retract the piston-rod assembly 20, thus controlling the downward force applied to the piston-rod assembly 20 during the process of forcing the drill-pipe seal assembly 100 into the drill-pipe string 640.

The method 500 may also include running the drill pipe (e.g., of the drill pipe string 620) into the wellbore 26, as at 526, to lower the casing string 620 farther into the wellbore 26. As the casing and drill-pipe strings 620, 640 are run into the wellbore 26, fluid (e.g., mud) from the wellbore 26 may flow up through the casing and drill-pipe strings 620, 640 and into the fluid connector tool 10. More particularly, the fluid may flow up through the flowpath 660 defined by the piston-rod assembly 20, the stationary tube 16, or both. The fluid may then flow out of the fluid connector tool 10 via a port 900 formed laterally through the cylinder 15 and into the pipe 222.

The method 500 may also include capturing the fluid that flows out of the fluid connector tool 10 via the pipe 222, as at 528. In at least one embodiment, at least a portion of the fluid may flow up and out of the fluid connector tool 10 through the upper end of the fluid connector tool 10, as described with reference to FIG. 10B below.

The ability of the fluid connector tool 10 to provide circulation (e.g., at 510) and flowback (e.g., at 526, 528, 530) functionality improves the efficiency, safety, and productivity of the operation. The fluid connector tool 10 remains coupled to the lifting assembly (e.g., top drive) 2 during the circulation, cross-over (e.g., at 514, 516, 518, 520), and flowback operations.

Figure 10A:
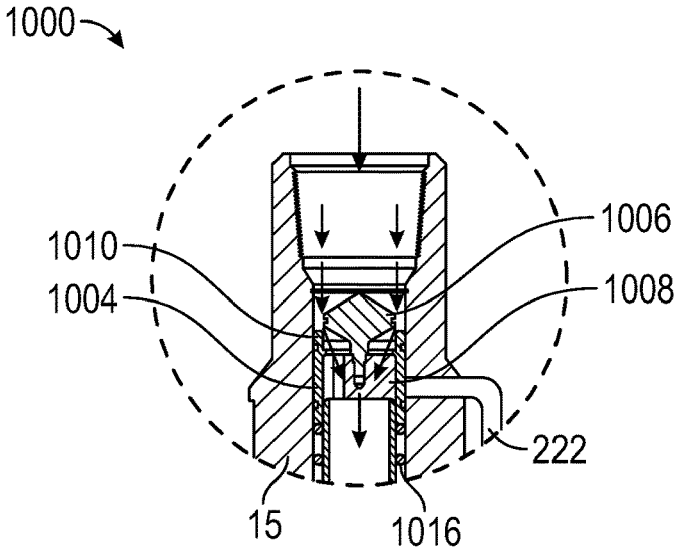
FIGS. 10A, 10B, and 10C illustrate a side, cross-sectional view of a valve assembly in the fluid connector tool in three different positions, according to an embodiment.
Figure 10B:
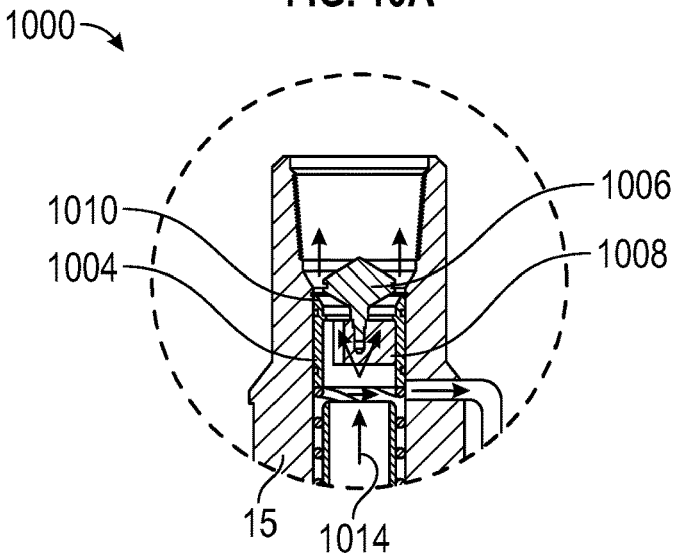
Figure 10C:
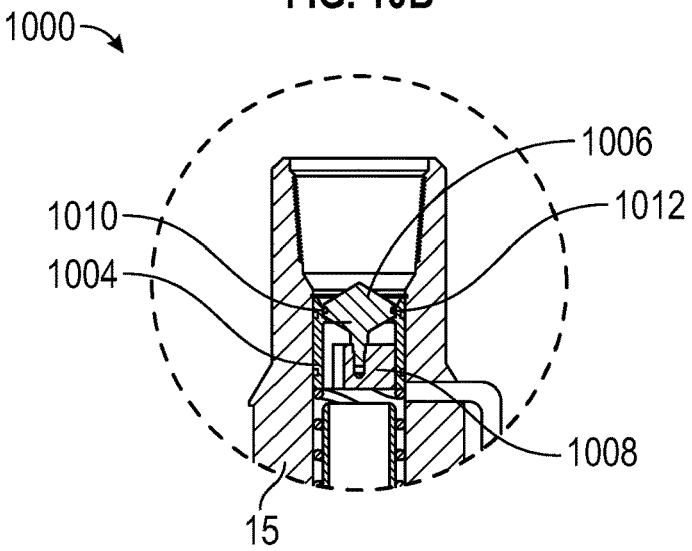

FIGS. 10A-C illustrate a valve assembly 1000 in the fluid connector tool 10 in three different positions, according to an embodiment. More particularly, FIG. 10A illustrates the valve assembly 1000 in a circulation position, FIG. 10B illustrates the valve assembly 1000 in a flowback position, and FIG. 10C illustrates the valve assembly 1000 in a static position. The valve assembly 1000 may include a body positioned at least partially within a sleeve 1004. The body may include a poppet 1006 and a poppet guide 1008. A cross-sectional width (e.g., diameter) of the poppet 1006 may be less than a cross-sectional width (e.g., diameter) of the sleeve 1004 to provide a path of fluid communication axially-past the poppet 1006. A cross-sectional width (e.g., diameter) of the poppet guide 1008 may be greater than or equal to the cross-sectional width (e.g., diameter) of the sleeve 1004.

When the valve assembly 1000 is in the circulation position (FIG. 10A), the poppet guide 1008 may be offset from a seat 1010 in the sleeve 1004, and the sleeve 1004 may be axially-aligned with the pipe 222. The seat 1010 may be defined by a decreasing inner cross-sectional width (e.g., diameter) of the sleeve 1004, a shoulder formed on the inner surface of the sleeve 1004, or a combination thereof. A downward "circulating" flow may flow past the poppet guide 1008 and the poppet 1006 and into the bore of the fluid connector tool 10. The downward flow may exert a downward force on the sleeve 1004 that pushes the sleeve 1004 downward to block/cover the pipe 222. When the downward force ceases, a spring 1016 may push the sleeve 1004 back upward so that it no longer blocks/covers the pipe 222. The valve assembly 1000 may be in the circulation position, for example, when the casing fill-up and circulation seal assembly 600 is coupled to the fluid connector tool 10.

When the valve assembly 1000 is in the flowback position (FIG. 10B), the poppet guide 1008 may be offset from the seat 1010 in the sleeve 1004. In addition, the sleeve 1004 may be axially-offset from the pipe 222. Thus, a flowpath 1014 may exist upward through the fluid connector tool 10 and (1) into the pipe 222, (2) through the sleeve 1004 (e.g., past the poppet guide 1008), or both. The valve assembly 1000 may be in the flowback position, for example, when the drill-pipe seal assembly 100 is coupled to the fluid connector tool 10.

When the valve assembly 1000 is in the static position (FIG. 10C), the poppet guide 1008 may be positioned at least partially within the sleeve 1004. More particularly, the poppet guide 1008 may be positioned within the seat 1010. A sealing member 1012 may be positioned around the poppet guide 1008. When the poppet guide 1008 is positioned at least partially within the sleeve 1004, as shown in FIG. 10A, the poppet guide 1008 (and the sealing member 1012) may prevent fluid from flowing axially-through the sleeve 1004. The sealing member 1012 may be, for example, an elastomeric O-ring. In at least one embodiment, the sleeve 1004 may be axially-offset from the pipe 222 when the valve assembly 1000 is in the static position.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A method for installing a tubular in a wellbore, comprising:

coupling a fluid connector tool to a lifting assembly;

coupling an adapter to a lower end of the fluid connector tool;

coupling a casing fill-up and circulation seal assembly to the fluid connector tool by connecting the casing fill-up and circulation seal assembly to the adapter;

coupling two segments of casing together to form a casing string, wherein at least one of the segments of casing is fluidically coupled to the casing fill-up and circulation seal assembly;

running the casing string into a wellbore;

pumping a first fluid from the lifting assembly, through the fluid connector tool and the casing fill-up and circulation seal assembly, and into the casing string as the casing string is run into the wellbore;

actuating a valve assembly in the fluid connector tool into a first position when the first fluid is pumped into the casing string, wherein the valve assembly comprises a sleeve and a valve body positioned at least partially within the sleeve, and when the valve assembly is in the first position, the sleeve blocks fluid flow between a bore of the fluid connector tool and a port extending laterally-through the fluid connector tool, and the valve body allows fluid flow through the sleeve;

de-coupling the casing fill-up and circulation seal assembly and the adapter from the fluid connector tool after the first fluid is pumped into the casing string; and coupling a drill-pipe seal assembly to the fluid connector tool after the casing fill-up and circulation seal assembly and the adapter are de-coupled from the fluid connector tool, wherein coupling the drill-pipe seal assembly to the fluid connector tool comprises coupling the drill-pipe seal assembly to a piston-rod of the fluid connector tool, and wherein the piston-rod is positioned at least partially within a body of the fluid connector tool;

coupling a drill pipe segment to another drill pipe segment to form a drill pipe landing string, wherein the drill pipe landing string is coupled to the casing string, and wherein the drill pipe landing string has a smaller diameter than the casing string; and introducing a second fluid into an annulus defined within the fluid connector tool, thereby causing the piston-rod to extend axially with respect to the body until the drill-pipe seal assembly seals at least one of in, on, or around the drill pipe landing string;

running the drill pipe landing string into the wellbore to lower the casing string farther into the wellbore, wherein a third fluid from the wellbore flows up the casing string and the drill pipe landing string and into the fluid connector tool as the drill pipe landing string is run into the wellbore; and actuating the valve assembly in the fluid connector tool into a second position when the drill pipe landing string is run into the wellbore, wherein when the valve assembly is in the second position, the sleeve allows flow between the bore of the fluid connector tool and the port, and the valve body allows fluid flow axially-through the sleeve.

2. The method of claim 1, wherein introducing the second fluid into the annulus defined within the fluid connector tool causes the piston-rod to extend axially with respect to the body until the drill-pipe seal assembly is inserted at least partially into the drill string.

3. The method of claim 1, further comprising capturing the third fluid as the third fluid flows through the port.

4. The method of claim 1, wherein the fluid connector tool remains coupled to the lifting assembly when the casing fill-up and circulation seal assembly is de-coupled from the fluid connector tool, and the drill-pipe seal assembly is coupled to the fluid connector tool.

5. A system for installing a tubular in a wellbore, comprising:

a fluid connector tool having a first end thereof configured to be coupled to a lifting assembly, wherein the fluid connector tool comprises:

a body having an axial bore extending at least partially therethrough, wherein a port is defined laterally-through the body to provide a path of fluid communication from the axial bore to an exterior of the body;

a piston-rod positioned at least partially within the bore;

a tube positioned at least partially within the piston-rod, wherein the tube is stationary with respect to the body; and a piston coupled to or integral with the piston-rod and positioned in an annulus formed between the body and the tube, wherein the piston-rod is configured to move axially with respect to the body between a retracted position and an extended position;

an adapter configured to be coupled to a lower end of the body when the piston-rod is in the retracted position;

a casing fill-up and circulation seal assembly configured to be coupled to the adapter, wherein the casing fill-up and circulation seal assembly is configured to be inserted at least partially into a casing segment so as to form a fluid flowpath between the bore of the body, the adapter, and an interior of the casing segment; and a drill-pipe seal assembly configured to be connected to an end of the piston-rod when the casing fill-up and circulation seal assembly and the adapter are disconnected from the lower end of the body, wherein the drill-pipe seal assembly is configured to extend into sealing engagement with a drill pipe by moving the piston-rod to the extended position.

6. The system of claim 5, wherein the piston-rod is in the retracted position when the casing fill-up and circulation seal assembly is coupled to the lower end of the body.

7. The system of claim 5, wherein the drill-pipe seal assembly is configured to be received into an open end of the drill pipe by moving the piston-rod to the extended position.

8. The system of claim 5, further comprising a valve assembly positioned at least partially within the bore, wherein the valve assembly comprises a sleeve and a valve body positioned at least partially within the sleeve, wherein, when the valve assembly is in a first position, the sleeve blocks fluid flow between the bore and the port, and the valve body allows fluid flow through the sleeve, and when the valve assembly is in a second position, the sleeve allows fluid flow between the bore and the port, and the valve body allows fluid flow through the sleeve.

9. A fluid connector tool, comprising:

a body having an axial bore extending at least partially therethrough, wherein a port is defined laterally-through the body to provide a path of fluid communication from the axial bore to an exterior of the body;

a piston-rod positioned at least partially within the bore;

a tube positioned at least partially within the piston-rod, wherein the tube is stationary with respect to the body; and a piston coupled to or integral with the piston-rod and positioned in an annulus formed between the body and the tube, wherein the piston-rod is configured to move axially with respect to the body from a retracted position to an extended position when fluid is introduced into a first portion of the annulus to exert a force on the piston;

wherein a lower end of the body is configured to be coupled to a casing fill-up and circulation seal assembly, wherein the piston-rod is configured to be coupled to a drill-pipe seal assembly when the casing fill-up and circulation seal assembly is not coupled to the lower end of the body, and wherein the drill-pipe seal assembly is configured to seal at least one of on, in, or around a tubular segment.

10. The fluid connector tool of claim 9, further comprising a valve assembly positioned at least partially within the bore, wherein the valve assembly comprises a sleeve and a valve body positioned at least partially within the sleeve.

11. The fluid connector tool of claim 10, wherein, when the valve assembly is in a first position, the sleeve blocks fluid flow between the bore and the port, and the valve body allows fluid flow through the sleeve, and when the valve assembly is in a second position, the sleeve allows fluid flow between the bore and the port, and the valve body allows fluid flow through the sleeve.

12. The fluid connector tool of claim 11, wherein, when the valve assembly is in a third position, the sleeve allows fluid flow between the bore and the port, and the valve body blocks fluid flow through the sleeve.

13. The fluid connector tool of claim 9, wherein the lower end of the body is configured to be coupled to the casing fill-up and circulation seal assembly via an adapter positioned therebetween, and wherein the piston-rod is configured to be coupled to the drill-pipe seal assembly when the adapter is not coupled to the lower end of the body.

* * * * *